US006060203A

United States Patent [19]

Coburn et al.

[11] Patent Number: 6,060,203

[45] Date of Patent: May 9, 2000

[54] HIGH GLOSS ELECTROSTATOGRAPHIC SUBSTRATES

[75] Inventors: John F. Coburn, Malden, Mass.; George Goedecke, Manchester; Pat Y. Wang, Londonderry, both of N.H.

[73] Assignee: Nashua Corporation, Nashua, N.H.

[21] Appl. No.: 08/703,536

[22] Filed: Aug. 27, 1996

[51] Int. Cl.[7] ..... G03G 13/20

[52] U.S. Cl. ..... 430/124; 430/18; 430/126

[58] Field of Search ..... 430/99, 104, 109, 430/124, 126, 18

[56] References Cited

U.S. PATENT DOCUMENTS

| | | | |
|---|---|---|---|
| 4,165,308 | 8/1979 | Serlin | 260/42.52 |
| 4,167,602 | 9/1979 | Serlin | 428/240 |
| 4,366,293 | 12/1982 | Tobias | 525/301 |
| 4,429,074 | 1/1984 | Mishiba et al. | 524/819 |
| 4,678,742 | 7/1987 | Tamagawa et al. | 430/523 |
| 4,820,618 | 4/1989 | Lawson et al. | 430/45 |
| 4,908,240 | 3/1990 | Auhorn et al. | 427/391 |
| 4,950,711 | 8/1990 | Suwala et al. | 524/819 |
| 5,093,449 | 3/1992 | Durney Cronin et al. | 526/318 |
| 5,112,717 | 5/1992 | Baxter et al. | 430/124 |
| 5,122,568 | 6/1992 | dePierne et al. | 524/824 |
| 5,141,988 | 8/1992 | Suwala et al. | 524/548 |
| 5,156,937 | 10/1992 | Alexandrovich et al. | 430/109 |
| 5,208,211 | 5/1993 | Kurotori et al. | 503/227 |
| 5,234,782 | 8/1993 | Aslam et al. | 430/99 |
| 5,234,783 | 8/1993 | Ng | 430/45 |
| 5,285,246 | 2/1994 | Danzuka et al. | 355/282 |
| 5,302,439 | 4/1994 | Malhotra et al. | 428/195 |
| 5,327,201 | 7/1994 | Coleman et al. | 355/278 |
| 5,337,132 | 8/1994 | Cherian | 355/278 |
| 5,366,837 | 11/1994 | Sakai | 430/97 |
| 5,392,104 | 2/1995 | Johnson | 355/278 |
| 5,441,838 | 8/1995 | Pane | 430/97 |
| 5,450,183 | 9/1995 | O'Leary | 355/285 |
| 5,451,458 | 9/1995 | Malhotra | 428/412 |
| 5,451,466 | 9/1995 | Malhotra | 428/500 |
| 5,506,671 | 4/1996 | Buts et al. | 355/326 |
| 5,652,075 | 7/1997 | Kanbayashi et al. | 430/106 |
| 5,852,462 | 12/1998 | Lloyd et al. | 347/156 |

FOREIGN PATENT DOCUMENTS

| | | | |
|---|---|---|---|
| 0194776 | 9/1986 | European Pat. Off. . | |
| 0354530 | 2/1990 | European Pat. Off. | G03G 13/16 |
| 0621510 | 10/1994 | European Pat. Off. | G03G 7/00 |
| 7248636 | 3/1994 | Japan . | |
| 9209936 | 6/1992 | WIPO | G03G 5/022 |

OTHER PUBLICATIONS

Database WPI, Section Ch, Week 9339, Derwent Publications Ltd., London, GB; Class A89, AN 93–306104, XP002048292 & JP 05 216 322 A (Konica Corp), Aug. 27, 1993.

Xeikon DCP–1 Bochure, 6 pages, Xeikon$_{nv}$, Vredebaan 72 ● 2640 Mortsel, Belgium, publication date unknown.

*Primary Examiner*—John Goodrow

*Attorney, Agent, or Firm*—Testa, Hurwitz & Thibeault, LLP

[57] ABSTRACT

A system and method for producing photographic-like output. In the method, an image is formed from image forming agent(s) on a specially coated substrate, after which the combination is fused to preferably form a uniform glossy finish on the substrate. A preferred application is in an electrostatographic process, comprising a system comprising (a) toner comprising a resin component having a glass transition temperature $T_{gT}$; and (b) a coated substrate comprising a coating having a glass transition temperature $T_{gC}$, where the resin component has a characteristic chemical compatibility with the coating.

22 Claims, 2 Drawing Sheets

HIGH GLOSS ELECTROSTATOGRAPHIC SUBSTRATES

FIELD OF THE INVENTION

This invention relates to imaging methods in general, and in particular, to methods for producing photographic-like output employing image forming agent(s) on a specially coated substrate.

BACKGROUND OF THE INVENTION

Current printing technologies such as ink-jet and electrostatographic printing, allow for very high quality output of both images and text. Electrostatographic processes and apparatus employ the use of toners, which are generally comprised of a resin and a colorant, along with other desirable additives like charge control agents. In general, a desired image is transferred to an organic photoconductor (OPC) coated drum or belt in the form of a charged pattern representing the image. Toner is then electrically attracted to the charge on the drum and adheres to the drum. Lastly, the toner is transferred to an image-receiving substrate (typically paper) and fused onto the substrate, resulting in permanent image formation on the substrate.

In the present art, it has been difficult to obtain a uniform glossy finish on the printed product. If, for example, a colored graphical image is printed on glossy paper but the image forming agent is not absorbed into the paper, the perception that one is looking at photograph is not obtained. Another example is in the electrostatographic area; using currently-available toners, a uniform glossy or even matte finish printed product cannot be obtained, except when special coatings applied to the print, or equipment for the same, are used. Since such additional process steps add cost, bother and time to the printing process, they are undesired. Even if a conventional glossy finish substrate such as transparent overhead material is used for printing, a uniform glossy image is surprisingly not obtained; the characters or image comprising the fused toner can still be made out from the rest of the otherwise glossy finish when one looks at the substrate off-angle. This becomes more apparent once one considers that the fused toner only sits on the surface of the glossy substrate.

Glossy electrostatographic prints, on regular or synthetic paper, e.g., Tyvek (DuPont trademark)-type materials, have long been desired. The advent of high speed, high resolution digital color electrostatographic printers such as those from Xeikon NV (Mortsel, Belgium) or Agfa Division of Bayer Corporation (Wilmington, Mass.) have made it possible for photographic digital images that are comparable in quality to silver halide-derived images to be made quickly and with great versatility. One drawback to obtaining customer acceptance of this new medium, however, is the unavailability of a glossy print generated from a digital photographic image that resembles the prints available from the photo lab. The glossy finish of such prints is well-known to enhance the intensity of the color image. If similar quality glossy prints could be made with, e.g., high speed digital color electrostatographic imaging systems using a simple substrate material requiring no additional treatment or equipment, other than feeding the material into the printer, it is believed that consumer and industry acceptance of this technology would increase greatly.

SUMMARY OF THE INVENTION

The present invention relates to systems and methods for producing photographic-like output. A system as presently disclosed comprises (a) at least one image forming agent and (b) a coated substrate comprising a coating having a glass transition temperature $T_{gC}$, where the image forming agent has a characteristic chemical compatibility with the coating. One embodiment is a system to be used in an electrostatographic process, comprising (a) toner comprising a resin component having a glass transition temperature $T_{gT}$; and (b) a coated substrate comprising a coating having a glass transition temperature $T_{gC}$, where the resin component has a characteristic chemical compatibility with the coating.

In accordance with the presently disclosed method, photographic-like output is produced by the steps of i) forming an image comprised of (a) at least one image forming agent on (b) a coated substrate comprising a coating having a glass transition temperature $T_{gC}$, where the image forming agent has a characteristic chemical compatibility with the coating, and ii) fusing the combination, to preferably form a uniform glossy finish on the substrate. In one embodiment, an electrostatographic process for producing photographic-like output, comprises the steps of i) forming a toner-bearing image on an image-receiving member, the toner comprising a resin component having a glass transition temperature $T_{gT}$; ii) transferring the toner-bearing image to a coated substrate comprising a coating having a glass transition temperature $T_{gC}$, and iii) fusing the toner-bearing image and the coating to form an image on the coated substrate, where the toner resin component has a characteristic chemical compatibility with the coating on the substrate. In a preferred embodiment the fusing is accomplished with radiant heat in a nipless process.

BRIEF DESCRIPTION OF THE DRAWINGS

The system and method disclosed herein will be more fully understood by referring to the detailed description in conjunction with the appended drawing of which.

DETAILED DESCRIPTION OF THE INVENTION

Figure 1:
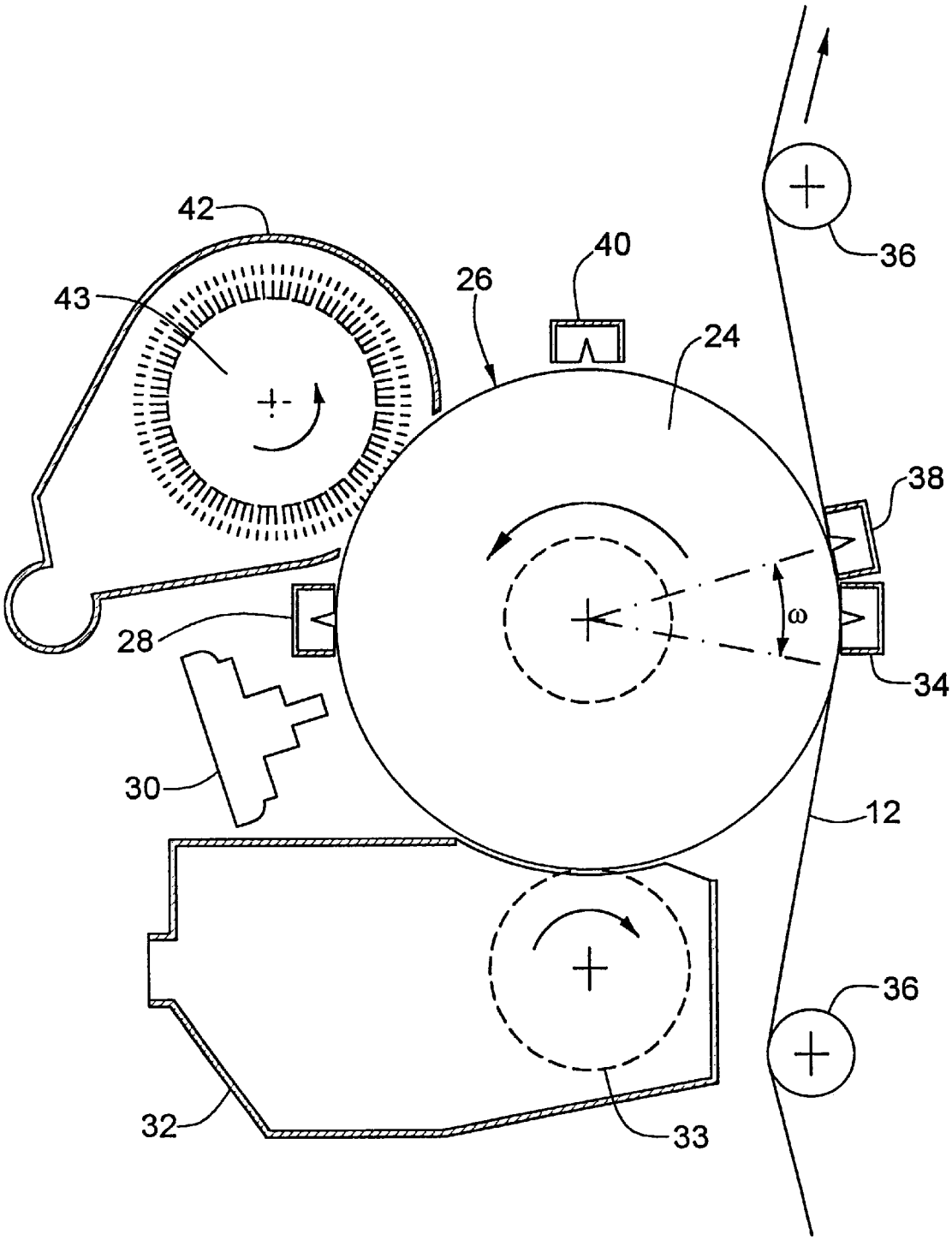
FIG. 1 is a cross-sectional view of one of the print stations of the printers shown in FIG. 2.

It has been recognized by the Applicants that high gloss photographic-like output in non-photographic (i.e., non-silver halide) imaging processes such as ink-jet and electrostatographic printing, may be obtained through the use of specially coated substrates having a coating chemically "matched" to the image forming agent (i.e., inks, toners, etc.) used to form the image. The image is formed on the substrate and adheres thereto, and the combination is then fused to produce a uniform finish, preferably a glossy one. Further, it has been recognized by the Applicants that coated substrates for electrostatographic printing advantageously having high gloss may be obtained by coating a substrate, typically paper, with a coating that is "matched" to the resin in the toner. More precisely, the toner is, while not necessarily identical in chemical makeup, chemically compatible with the paper coating, meaning that under fusing conditions (particularly when radiant heat is the fusing source) the toner particles soften and penetrate into the substrate coating, rather than deposit themselves on the surface. When the toner is transferred from the recording member to the coated substrate under the appropriate fusing conditions, the charged toner, being electrostatically attracted to the coating and the underlying substrate, is absorbed into the coating because of the compatibility between the toner resin and the coating, resulting in a uniform gloss on the printed product. The chemical compatibility can be attributed to a number of factors, including the presence of like chemical groups, hydrogen bonding, or van der Waals attraction between the toner resin and the coating. Additionally, due in part to the 'self-leveling' nature of the coating under electrostatographic printing conditions, a uniform gloss coating is obtained.

The presently disclosed coated papers are particularly suitable for use in high-speed continuous electrostatographic printers such as described below, in which the coated substrate is fed into the machine in roll form. A surprising advantage of certain of the presently disclosed coatings is that they are non-blocking, i.e., as a roll of the material is unwound, the coated surface does not stick to the roll. This is an important requirement, because of the high speeds at which these printers operate, i.e., web speeds in excess of 50 cm/s. Papers which have coatings which are not inherently non-blocking may further comprise a release coating, e.g., siloxane-based polymers, to aid in the high speed unrolling of the web. If anti-blocking agents, e.g., fluorocarbon waxes, dispersed paraffinic waxes such as dispersed stearamides, are needed, they may be added to the coating in effective amounts, so long as the performance of the coating is not diminished.

The coated paper may initially have a matte finish that is converted to a gloss or semi-gloss finish upon fusing during the electrostatographic process. A substrate as presently disclosed may, less desirably (because it looks less like a photograph), be such that upon fusing a matte finish is obtained. In a preferred embodiment, however, and in order to obtain optimum improvement of color intensity and more photographic-like appearance of the printed product, coatings which provide high gloss values, i.e., about 60% to 95% (as measured at 60° by a GLOSSGARD II glossimeter (Gardner)) after fusing are preferred.

The coating material may be applied to the substrate using conventional coating methods, e.g., air knife, docter blade, reverse gravure kiss-roll, etc., so as to obtain a good coating. Good results have been obtained with substrates coated at coating weights of 5 to 15 lb/3000 $ft^2$. Alternately, the coating may be applied as a particulate polymer coating that adheres to the substrate, and which forms the uniform glossy coating upon fusing.

It has been further recognized that, in electrostatographic processes, good results are obtained when the glass transition temperature of the coating ($T_{gC}$) is less than or equal to the glass transition temperature of the toner (resin). In particular a $T_{gC}$ range of 10° C. to 50° C. is preferred.

Dry toner may be a one-component toner or a two component toner. Single component developers operate solely with toner particles, in that carrier particles are absent for triboelectric charging. In two component toners, the toner particles are mixed with carrier particles providing a definite triboelectric charge polarity to the toner particles. For magnetic brush development, magnetizable carrier particles are required.

Dry toners essentially comprise a thermoplastic binder consisting of a thermoplastic resin or mixture of resins, and colorants such as carbon black, finely dispersed dye pigments, or soluble dyes, and may further include infra-red or ultra-violet absorbing substances and substances that produce black in admixture. Suitable resins for use include transparent thermoplastic resins such as polyesters, polyethylenes, polystyrenes and copolymers thereof such as styreneacrylic resin and styrene-butadiene resin; (meth) acrylates; polyvinyl chlorides; vinyl acetates; copoly(vinyl chloride-vinyl acetate); copoly(vinyl chloride-vinyl acetate-maleic acid); vinyl butyryl resins; polyvinyl alcohols; polyurethanes; polyamides; polyolefins; and styrene polymer. Polyester resins have been found to be particularly suitable. Certain polyester resins with advantageous properties, e.g., improved abrasion resistance, comprise linear polycondensation products of (i) difunctional organic acids, e.g., maleic acid, fumaric acid, terephthalic acid and isophthalic acid and (ii) difunctional alcohols such as ethylene glycol, trimethylene glycol, and aromatic dihydroxy compound, preferably called "bisphenol A" or an alkoxylated bisphenol, e.g., propoxylated bisphenol.

When polyester-based toners are used, polyurethane coatings, acrylic emulsions, and styrene-acrylic copolymer emulsions give good results, with the polyurethanes being particularly preferred. The polyurethane coatings may be dispersion or emulsion-based.

Toners for producing color images may contain organic dyes or pigments of the group of phthalocyanine dyes, quinacridone dyes, triaryl methane dyes, sulfur dyes, acridine dyes, azo dyes and fluorescein dyes. The mean diameter of dry toner particles for use in magnetic brush development is 10$\mu$ in general-purpose applications, but may range from 1 to 5$\mu$ for high resolution development.

The triboelectric chargeability of the toner particles, defined by the binder resin and colorants, may be modified or enhanced with charge controlling agents. In response to the electric field of the latent image, the toner transfers from the carrier beads to the recording material containing an electrostatic charge pattern. Different methods, such as cascade, magnetic brush, powder cloud, impression or transfer/touchdown development, can be used to deliver toner to the recording member carrying the latent electrostatic image.

In magnetic brush development, toner particles are mixed with carrier particles comprising ferromagnetic material, e.g., steel, nickel, iron beads, ferrites, or mixtures thereof. The ferromagnetic particles may be coated with resin, or are present in a resin binder mass. The average particle size of the carrier particles is typically in the range of 20 to 200$\mu$. The carrier particles possess sufficient density and inertia to avoid adhering to the electrostatic charge images during the development process. The carrier particles can be mixed with the toner particles in various ratios. The shape of the carrier particles, their surface coating and their density determines their flow properties. The electrostatically deposited toner particles may be fused with the coated substrate using known heat-fixing methods, e.g., by radiant heat.

The invention will now be further understood by reference to the following description of electrostatographic processes, and an exemplary apparatus for producing photographic-like output.

"Electrostatographic printing" is defined herein to include both electrographic and electrophotographic printing. (As used herein, the term "electrostatographic" also includes the direct image-wise application of electrostatic charges on an insulating support, for example by ionography.) In electrographic printing, an electrostatic charge is deposited image-wise on a dielectric recording member. In electrophotographic printing, an overall electrostatically charged photoconductive dielectric recording member is image-wise exposed to conductivity increasing radiation producing thereby a "direct" or "reversal" toner-developable charge pattern on the recording member. "Direct" development is a positive-positive development, and is suited for producing graphics and text. "Reversal" development is a "positive-negative" or vice versa development process and is of particular interest when the exposure derives from an image in digital electrical form, wherein the electrical signals modulate a laser beam or the light output of light-emitting diodes (LEDs).

The exemplary printer construction described below is a multi-color printer comprising magenta, cyan, yellow and black image-producing stations. A commercially available printer fitting this description is the Xeikon DCP-1. This printer comprises a fusing/"image fixing" station downstream of all the image-producing stations, (intermediate fixing between image-producing stations is also possible.) The image fixing station as described is preferably of the radiant heat type. The printer described below features a roll stand for unwinding a roll of web to be printed in the printer (i.e., coated substrate as presently disclosed herein), and a web cutter for cutting the printed web into sheets.

The web is typically conveyed through the printer at a speed of from 5 cm/s to 50 cm/s, and the tension in the web at each image-producing station is typically between 0.2 to 2.0 N/cm web width.

A corona discharge device is used to transfer toner by spraying charged particles having a charge opposite to that of the toner particles. The supply current fed to the corona discharge device is, e.g., 1 to 10 $\mu$A/cm web width, preferably 2 to 5 $\mu$A/cm web width (depending upon the paper characteristics), and will be positioned at a distance of from 3 mm to 10 mm from the path of the web.

In the description which follows, the formation of images by the "reversal" development mode is described. One skilled in the art will appreciate however, that the same principles can be applied to "direct" development image formation.

As shown in FIG. 1, each printing station comprises a cylindrical drum 24 having a photoconductive outer surface 26. Circumferentially arranged around the drum 24 there is a main corotron or scorotron charging device 28 capable of uniformly charging the drum surface 26, for example to a potential of 600 V, an exposure station 30 which may, for example, be in the form of a scanning laser beam or an LED array, which will imagewise and linewise expose the photoconductive drum surface 26, causing the charge on the latter to be selectively dissipated, for example to a potential of about −250 V, leaving an image-wise distribution of electric charge to remain on the drum surface 26. This "latent image" is rendered visible in reversal development mode by a developing station 32 which includes an electrically biased magnetic brush 33 which brings toner particles in contact with the drum surface 26.

In the developing station 32 the developer drum 33, is adjustably mounted, enabling it to be moved radially towards or away from the drum 24.

Figure 2:
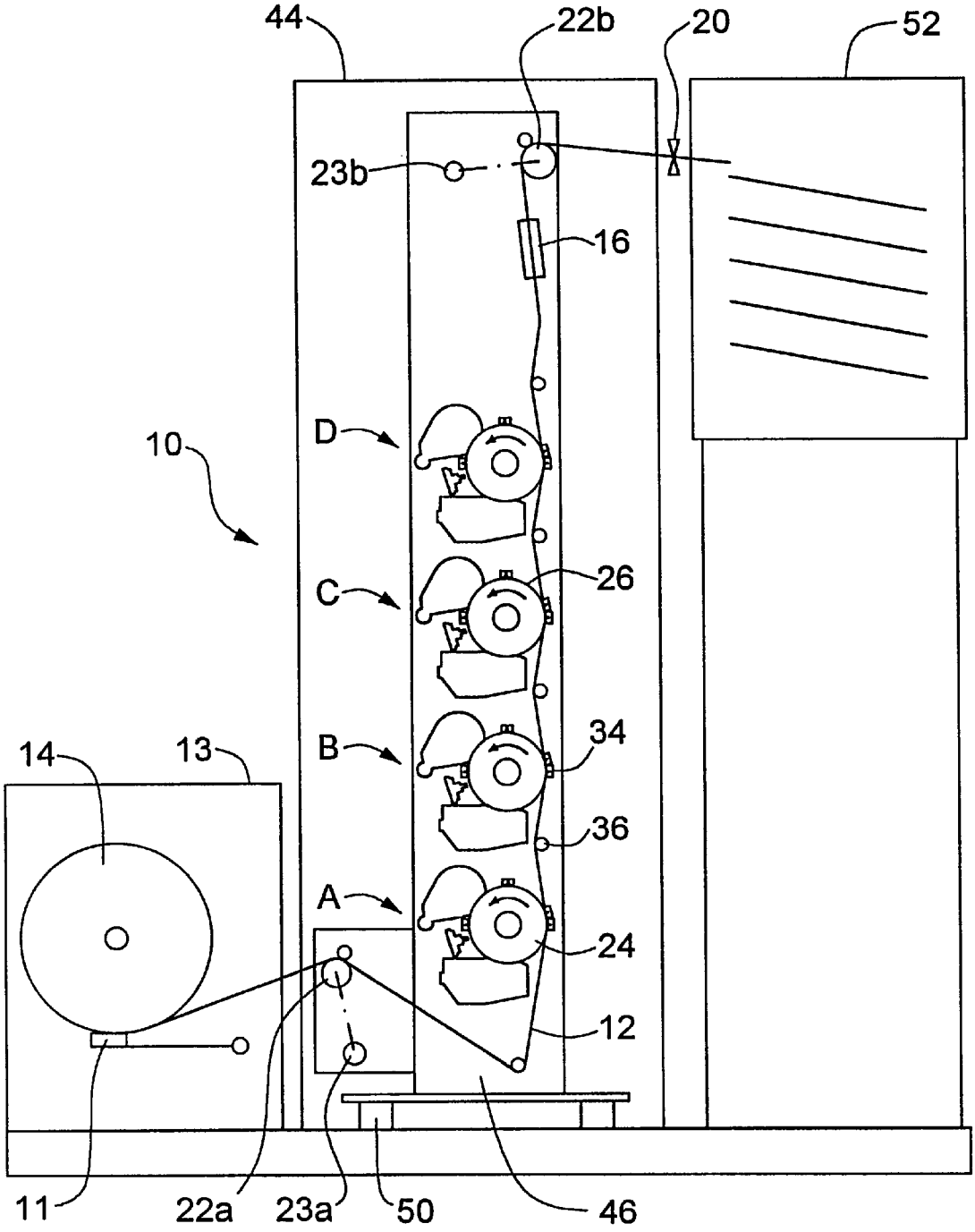
FIG. 2 shows an exemplary electrostatographic single-pass multiple station printer that may be used in the invention.

The printer 10 in FIG. 2 comprises four printing stations A, B, C and D, which are arranged to print yellow, magenta, cyan and black images, respectively. The printer has a supply station 13 in which a roll 14 of web material 12 is housed in sufficient quantity to print a desired number of images. The web 12 is conveyed into a tower-like printer housing 44 in which a support column 46 is provided, housing printing stations A to D.

After leaving the final printing station D, the image on the web is fixed by means of the image-fixing station 16 and fed to a cutting station 20 and a stacker 52 if desired.

The web 12 is conveyed through the printer by two drive rollers 22*a*, 22*b* one positioned between the supply station 13 and the first printing station A and the second positioned between the image-fixing station 16 and the cutting station 20. The drive rollers 22*a*, 22*b* are driven by controllable motors, 23*a*, 23*b* is speed controlled at a rotational speed to move the web through the printer at the required speed, e.g., 125 mm/sec. The other motor is torque controlled so as to generate a desired web tension. The moving web 12 is in face-to-face contact with the drum surface 26 over a wrapping angle of about 15° determined by the position of guide rollers 36.

The developing unit 32 includes a brush-like developer drum 33 which rotates in the same direction as the drum 24. In a typical construction of a developer station, the developer drum 33 contains magnets carried within a rotating sleeve causing the mixture of toner and magnetizable material to rotate therewith, to contact the surface 26 of the drum 24 in a brush-like manner. Negatively charged toner particles are charged to a charge level of, e.g., 9 $\mu$C/gV and are attracted to the photo-exposed areas on the drum surface 26 by the electric field between those areas and the negatively electrically biased developer so that the latent image becomes visible. The toner image adhering to the drum surface 26 is then transferred to the moving web 12 by a transfer corona device 34. The transfer corona device, being on the opposite side of the web to the drum, and having a high potential opposite in sign to that of the charge on the toner particles, attracts the toner particles away from the drum surface 26 and onto the surface of the web 12. The transfer corona device typically has its corona wire positioned about 7 mm from the housing which surrounds it and 7 mm from the paper web. A typical transfer corona current is about 3 $\mu$A/cm web width. The transfer corona device 34 also serves to generate a strong adherent force between the web 12 and the drum surface 26, causing the latter to be rotated in synchronism with the movement of the web 12 and urging the toner particles into firm contact with the surface of the web 12. The web, however, should not tend to wrap around the drum beyond the point dictated by the positioning of a guide roller 36 and there is therefore provided circumferentially beyond the transfer corona device 34 a web discharge corona device 38 driven by alternating current and serving to discharge the web 12 and thereby allow the web to become released from the drum surface 26. The web discharge corona device 38 also serves to eliminate sparking as the web leaves the surface 26 of the drum.

Thereafter, the drum surface 26 is pre-charged to a level of, e.g., −580 V, by a pre-charging corotron or scorotron device 40. The pre-charging corona device 40 makes the final charging by the corona 28 easier. Any residual toner which might still cling to the surface of the drum is collected at a cleaning unit 42 known in the art. The cleaning unit 42 includes a rotatable cleaning brush 43 which is driven to rotate in a direction opposite to that of the drum 24 and at a peripheral speed of, say, twice the peripheral speed of the drum surface. The position of the cleaning brush 43 can be adjusted towards or away from the drum surface 26 to ensure optimum cleaning. The cleaning brush is earthed or subjected to such a potential with respect to the drum as to attract the residual toner particles away from the drum surface. After cleaning, the drum surface is ready for another recording cycle. After passing the first printing station A, as described above, the web passes successively to printing stations B, C and D, where other images are transferred to the web. For a proper color image to be formed, the images produced in the successive color toner stations must be in register with each other.

The following non-limiting examples illustrate specific embodiments of the invention.

EXAMPLE 1

A polyurethane-based coating for making a coated paper as disclosed herein is made as follows. The following chemicals are placed in a reaction vessel and combined:

| Chemical | Parts by weight |
|---|---|
| polypropylene glycol (MW = 2000) | 190.00 |
| polypropylene glycol (MW = 425) | 862.00 |
| dimethylpropionic acid | 118.00 |
| methyl ethyl ketone ("MEK") | 1380.00 |
| tolylene 2,4-diisocyanate | 632.10 |
| dibutyltindilaurate | 2.22 |
| 1,4-diazabicyclo[2,2,2]octane | 7.20 |

The mixture is refluxed for six hours at 80° C. In a separate vessel a second mixture is made by combining 205 parts ammonium hydroxide, 3.00 parts 2-methylpentamethyldiamine (DYTEK A AMINE, E. I. duPont) and 3800 parts water, then mixing for 10 minutes. The first mixture is then added to the second and vigorously mixed for 10 minutes. Lastly, the final mixture is converted to a water-based polyurethane dispersion by removing the MEK by distillation. The physical characteristics of the resulting polyurethane dispersion are: 35–40% solids; pH between 7.5 and 8.0; $T_g$ of approximately 18° C.; and a viscosity of 250–450 cps as measured in a Brookfield LVT viscometer.

The polyurethane dispersion coating may be coated onto bright white roll paper stock (either, e.g., Russell Field 130 g/3000 sq ft. or a coated Westvaco 100 lb/3000 sq ft., on a nine inch web) using a reverse gravure kiss-roll setup. After coating the paper enters an eight foot drying oven divided into two zones. The first zone is heated to approximately 150° F. and the second to approximately 220° F. (although it may be necessary to tailor these temperatures for the particular coating used, e.g., for polyurethane coatings both zones must be operated at about 150° F., to avoid blisters.) The paper exits the oven at a tension controlling roll, where an infrared (IR) heat lamp allows for an optional third drying step, which is found desirable for good results with polyurethane coatings. Typically, the temperature in this zone is about 300° F. The paper then passes through a tension roll device, then on to a take-up roll. The coating speed was 10 ft/m, and the coating weight is 8–12 lb/3000 sq ft.

The paper may be loaded into a Xeikon DCP-1 electrostatographic digital color press to print color graphical images printed on the paper. No blocking is observed as the paper unrolls. The printed product exhibited a high quality gloss and photographic-like quality, compared to images printed on conventional coated paper or non-coated paper. The coating also shows significant improvements in color density, as measured by an X-Rite 408 densitometer:

| Material | Yellow | Cyan | Magenta | Black |
|---|---|---|---|---|
| Non-coated paper | 0.88 | 0.93 | 0.94 | 1.29 |
| Coated paper | 1.13 | 1.30 | 1.34 | 1.97 |

EXAMPLE 2

A coated paper may be made as in Example 1, substituting a dispersion of an acrylic copolymer (Zeneca Neocryl XA-6077) for the polyurethane dispersion of Example 1. The anti-blocking properties of this paper are not as good as that of the paper of Example 1, but the gloss and color density improvement is greatly improved over the non-coated paper.

The foregoing description is meant to be illustrative of a novel technique for producing photographic-like output. Other embodiments and variations thereof will be apparent to those of ordinary skill in the art without departing from the inventive concepts contained herein. Accordingly, this invention is to be viewed as embracing each and every novel feature and novel combination of features present in or possessed by the invention disclosed herein and is to be viewed as limited solely by the scope and spirit of the appended claims.

What is claimed is:

1. A system for producing photographic-like output having a uniform glossy finish in an electrostatographic process, comprising:

(a) a toner comprising a polyester resin component having a glass transition temperature $T_{gT}$; and (b) a coated substrate comprising a coating selected from the group consisting of polyurethane coatings, acrylic emulsions, and styrene-acrylic copolymer emulsions having a glass transition temperature $T_{gC}$, wherein said polyester resin component has a characteristic chemical compatibility with said coating such that said toner is absorbed into said coating.

2. The system of claim 1 wherein said coating is glossy.

3. The system of claim 2 wherein said coating has a gloss value of about 60% to 95% as measured by a glossimeter.

4. The system of claim 1 wherein said $T_{gC}$ is in the range of about 10° C. to 50° C.

5. The system of claim 1 wherein said $T_{gC}$ is less than or equal to said $T_{gT}$.

6. The system of claim 1 wherein said coating is a particulate polymer coating.

7. The system of claim 1 wherein said coating is anti-blocking.

8. The system of claim 1 wherein said resin component is a polyester selected from the group consisting of linear polycondensation products of difunctional organic acids and difunctional alcohols.

9. The system of claim 8 wherein said difunctional organic acid is selected from the group consisting of maleic acid, fumaric acid, terephthalic acid and isophthalic acid, and said difunctional alcohol is selected from the group consisting of ethylene glycol, trimethylene glycol, bisphenol A and alkoxylated bisphenol.

10. A system for producing photographic-like output having a uniform glossy finish in an electrostatographic process, comprising:

(a) a toner comprising a polyester resin component having a glass transition temperature $T_{gT}$; and (b) a coated substrate comprising a polyurethane-based coating having a glass transition temperature $T_{gC}$ in the range of about 10° C. to 50° C. and a gloss value of about 60% to 95% as measured by a glossimeter, wherein said polyester resin component has a characteristic chemical compatibility with said polyurethane-based coating such that said toner is absorbed into said polyurethane-based coating.

11. An electrostatographic process for producing photographic-like output having a uniform glossy finish, comprising the steps of:

i) forming an image, said image defined by a toner disposed on an image-receiving member, said toner comprising a polyester resin component having a glass transition temperature $T_{gT}$;

ii) transferring said image to a coated substrate comprising a coating selected from the group consisting of polyurethane coatings, acrylic emulsions, and styrene-acrylic copolymer emulsions having a glass transition temperature $T_{gC}$; and iii) fusing said image and said coating, wherein said polyester resin component has a characteristic chemical compatibility with said coating on said substrate such that said toner is absorbed into said coating.

12. The process of claim 11 wherein said fusing is accomplished with radiant heat in a nipless process.

13. The process of claim 11 wherein said coating is glossy before said image is fused to said coating.

14. The process of claim 11 wherein said coating has a gloss value after said fusing step of about 60% to 90% as measured by a glossimeter.

15. The process of claim 11 wherein said $T_{gC}$ is in the range of about 10° C. to 50° C.

16. The process of claim 11 wherein said $T_{gC}$ is less than or equal to said $T_{gT}$.

17. The process of claim 11 wherein said coating is a particulate polymer coating.

18. The process of claim 11 wherein said coating is anti-blocking.

19. The process of claim 11 wherein said resin component is a polyester selected from the group consisting of linear polycondensation products of difunctional organic acids and difunctional alcohols.

20. The process of claim 19 wherein said difunctional organic acid is selected from the group consisting of maleic acid, fumaric acid, terephthalic acid and isophthalic acid, and said difunctional alcohol is selected from the group consisting of ethylene glycol, trimethylene glycol, bisphenol A and alkoxylated bisphenol.

21. An electrostatographic process for producing photographic-like output having a uniform glossy finish, comprising the steps of:

i) forming an image, said image defined by a toner disposed on an image-receiving member, said toner comprising a polyester resin component having a glass transition temperature $T_{gT}$;

ii) transferring said image to a coated substrate comprising a polyurethane-based coating having a glass transition temperature $T_{gC}$ in the range of about 10° C. to 50° C. and a gloss value of about 60% to 95% as measured by a glossimeter; and iii) fusing said image and said coating, wherein said polyester resin component has a characteristic chemical compatibility with said polyurethane-based coating on said substrate such that said toner is absorbed into said polyurethane-based coating.

22. A photographic-like image having a uniform glossy finish formed on a coated substrate by an electrostatographic process comprising:

a substrate;

a coating selected from the group consisting of polyurethane coatings, acrylic emulsions, and styrene-acrylic copolymer emulsions disposed on a surface of said substrate, said coating having a glass transition temperature $T_{gC}$; and a toner fused to said coating in the form of an image, said toner comprising a polyester resin component having a glass transition temperature $T_{gT}$, wherein said polyester resin component has a characteristic chemical compatibility with said coating such that said toner is absorbed into said coating.

* * * * *